US009212863B1

(12) United States Patent
Weinstock

(10) Patent No.: US 9,212,863 B1
(45) Date of Patent: Dec. 15, 2015

(54) TOY PROJECTILE SYSTEM AND METHOD THAT UTILIZES BI-STABLE RIBBON SPRING PROJECTILES

(71) Applicant: Brian F. Weinstock, St. Louis, MO (US)

(72) Inventor: Brian F. Weinstock, St. Louis, MO (US)

( * ) Notice: Subject to any disclaimer, the term of this patent is extended or adjusted under 35 U.S.C. 154(b) by 0 days.

(21) Appl. No.: 14/225,406

(22) Filed: Mar. 25, 2014

(51) Int. Cl.
*F41B 7/02* (2006.01)
*A63H 33/18* (2006.01)
*A63F 9/02* (2006.01)

(52) U.S. Cl.
CPC ..... *F41B 7/02* (2013.01); *A63F 9/0278* (2013.01); *A63H 33/18* (2013.01)

(58) Field of Classification Search
CPC ..... F41B 7/02; A63H 33/18; F16F 1/027; F16F 1/18
See application file for complete search history.

(56) References Cited

U.S. PATENT DOCUMENTS

| | | | | |
|---|---|---|---|---|
| 7,347,019 | B1 * | 3/2008 | Shaw | 40/607.01 |
| 2003/0155389 | A1 * | 8/2003 | Swartzentruber | 224/164 |
| 2004/0104532 | A1 * | 6/2004 | Ben-Yaakov | 273/342 |
| 2013/0149936 | A1 * | 6/2013 | Tiefel et al. | 446/486 |

* cited by examiner

*Primary Examiner* — John Ricci
(74) *Attorney, Agent, or Firm* — LaMorte & Associates, P.C.

(57) ABSTRACT

A toy assembly containing projectiles and a launcher. The launcher is a static structure having a hook projection extending therefrom. The projectile contains a length of coiled ribbon spring that causes the projectile to be biased into a curled configuration. The projectile stores spring energy when unwound from its coiled configuration. The projectile can be made bi-stable so that it can lay at rest in both its initial coiled configuration and a straightened linear configuration. A mechanical connector temporarily engages the first end of the projectile with the launcher. Once the projectile is engaged with the launcher, the first end of the projectile is held in place as the projectile is uncoiled out of its initial coiled configuration. When the projectile is released, it recoils and launches the projectile forward.

15 Claims, 9 Drawing Sheets

TOY PROJECTILE SYSTEM AND METHOD THAT UTILIZES BI-STABLE RIBBON SPRING PROJECTILES

BACKGROUND OF THE INVENTION

1. Field of the Invention

In general, the present invention relates to systems and methods that utilize bi-stable ribbon springs, commonly known as "slap bands" or "slap bracelets". The present invention also relates to toy projectile systems that launch projectiles using spring energy stored within the projectile at the time of launch.

2. Prior Art Description

Ribbon coil springs have been in existence for centuries. Ribbon coil springs are thin ribbons of steel that have been wound into a spiral and are biased into that shape. Ribbon coil springs are used in thousands of mechanisms, such as wind-up clocks, music boxes and spring hinges. However, it has only been in the past few decades that people have taken short segments of ribbon coil springs and made "slap band" devices.

A slap band is a short segment of coiled ribbon spring that is made bi-stable so that it can be straightened from its coiled configuration into a stable straight configuration. However, the stability of the straight configuration is tenuous. If the slap band is deformed from its straight configuration, it will immediately return to its coiled configuration. Slap bands are typically made into lengths that can coil about a person's wrist. In this manner, the slap band can be initially manipulated into its straight configuration. The slap band is slapped against a person's wrist, wherein the slap band immediately curls around the person's wrist.

Having the described operation, it is only natural that slap bands have been decorated and used as bracelets and as watchbands. Such prior art applications are exemplified by U.S. Patent Application Publication No. 2003/0155389 to Swartzentruber, entitled Slap On Band. Slap bands have been incorporated into other consumer products, such as bag holders and cuff holders. Such prior art is exemplified by U.S. Pat. No. 7,347,019 to Shaw, entitled Devices Incorporating A Bi-Stable Ribbon Spring. Slap bands have also be utilized in the toy industry. However, they have only been used as game pieces. Such prior art is exemplified by U.S. Patent Application No. 2004/0104532 to Ben-Yaakov, entitled Game Pieces And Game.

Although slap bands have been used for many consumer products and even for some toy products, the slap bands have always been used to wrap around another object. In the present invention, the structure of a slap band has been modified and is used in a novel manner. The slap band is not used to wrap around an object. Rather, the structure of the slap band is used as a projectile, wherein the spring energy stored in the slap band provides the energy needed to launch the projectile at speed.

The details of the present invention are described and claimed below.

SUMMARY OF THE INVENTION

The present invention is a toy assembly containing projectiles and a launcher. The launcher is a static structure having a hook projection extending therefrom. The projectile contains a length of coiled ribbon spring that causes the projectile to be biased into a curled configuration. The projectile stores spring energy when unwound from its coiled configuration.

The projectile can be made bi-stable so that it can lay at rest in both its initial coiled configuration and a straightened linear configuration.

A mechanical connector is provided at the first end of the projectile proximate. The connector enables the projectile to engage the launcher. Once the first end of the projectile is engaged with the launcher, the first end of the projectile is held in place as the projectile is uncoiled out of its initial coiled configuration. As the projectile is uncoiled, it stores spring energy. When the projectile is released, it immediately recoils. This launches the projectile forward as it automatically disengages from the launcher. The projectile being launched is coiled, therefore, it is circular in shape. This enables the projectile to be launched as a rolling projectile along the ground.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention toy system can be embodied in many ways, the illustrations provided show only a few exemplary embodiments. The exemplary embodiments are selected in order to set forth some of the best modes contemplated for the invention. The illustrated embodiments, however, are merely exemplary and should not be considered limitations when interpreting the scope of the appended claims.

Figure 1:
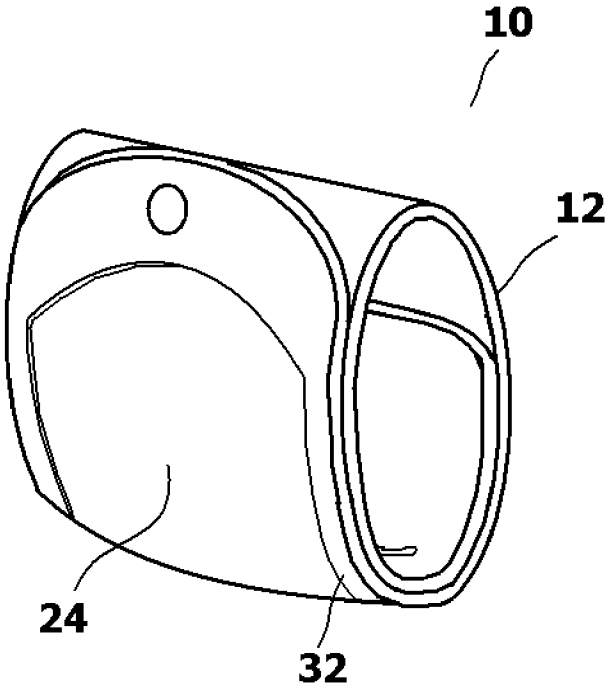
FIG. 1 is a perspective view of an exemplary embodiment of a projectile assembly in a coiled configuration.
Figure 2:
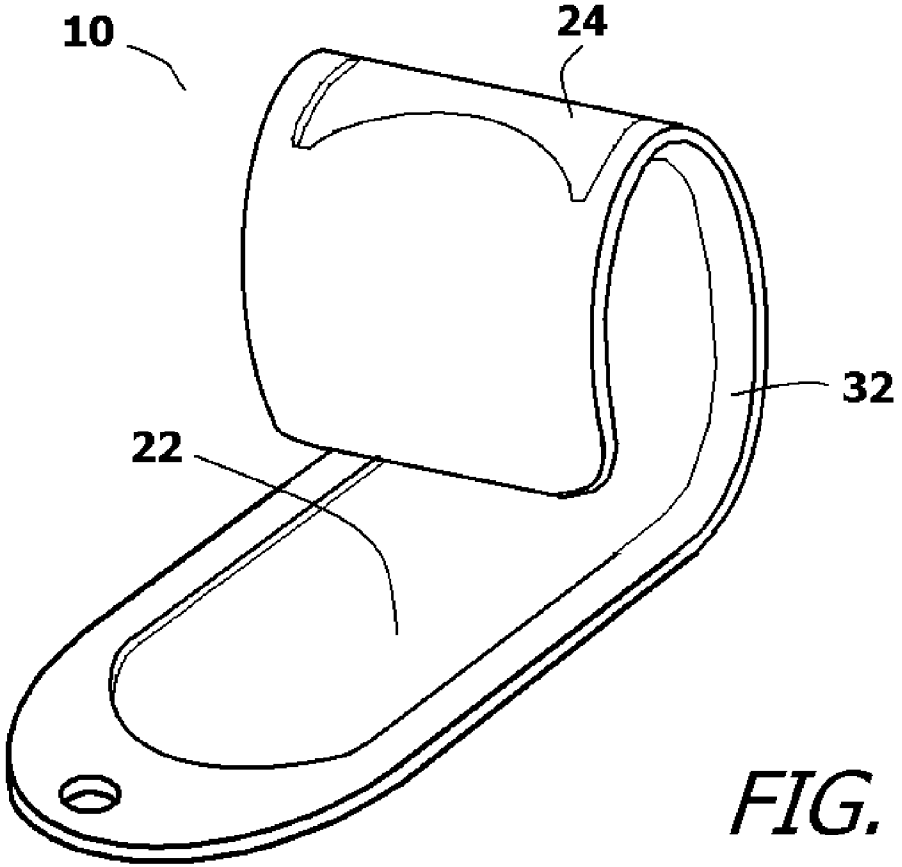
FIG. 2 is a perspective view of the projectile assembly of FIG. 1 shown in an unstable configuration.
Figure 3:
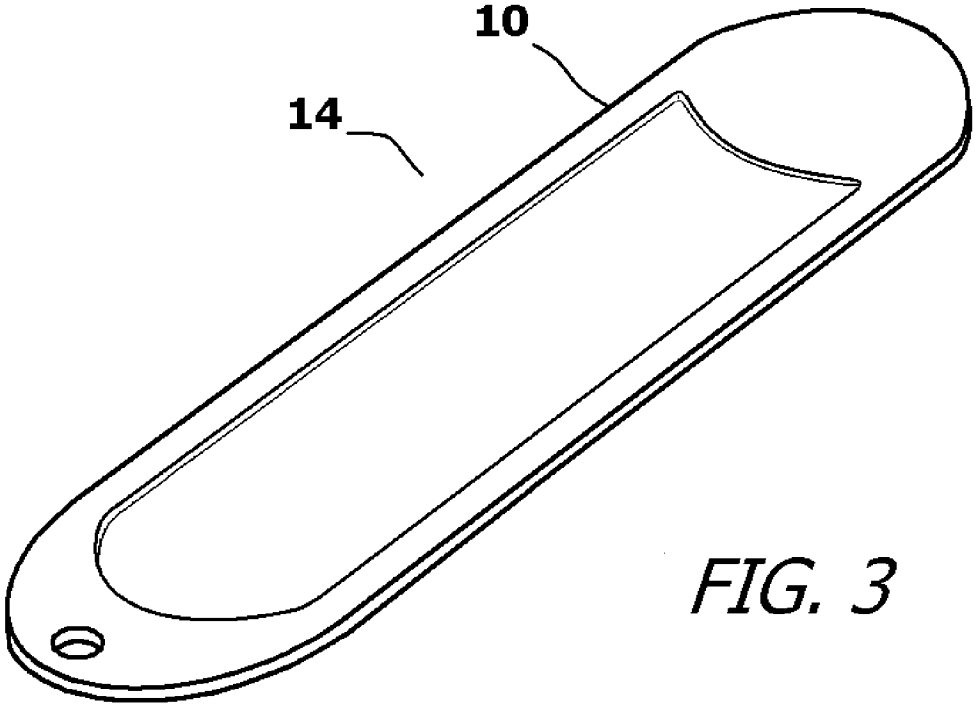
FIG. 3 is a perspective view of the projectile assembly of FIG. 1 shown in a linear configuration.

Referring to FIG. 1, in conjunction with both FIG. 2 and FIG. 3, a projectile assembly 10 is shown. The projectile assembly 10 is bi-stable. That is, the projectile assembly 10 can stand at rest in one of two stable configurations. The first stable configuration is shown in FIG. 1. In FIG. 1, the projectile assembly 10 winds around itself into a coiled configuration 12. The second stable configuration is shown in FIG. 3. In FIG. 3, the projectile assembly 10 lays in a straightened linear configuration 14.

FIG. 2 shows the projectile assembly 10 in an unstable configuration halfway between the stable coiled configuration 12 of FIG. 1 and the stable linear configuration 14 of FIG. 3. The projectile assembly 10 only passes through the unstable configuration as it is being manually unwound from the coiled configuration 12 to the linear configuration 14, or when the projectile assembly 10 recoils from its linear configuration 14 back to its coiled configuration 12.

Figure 4:
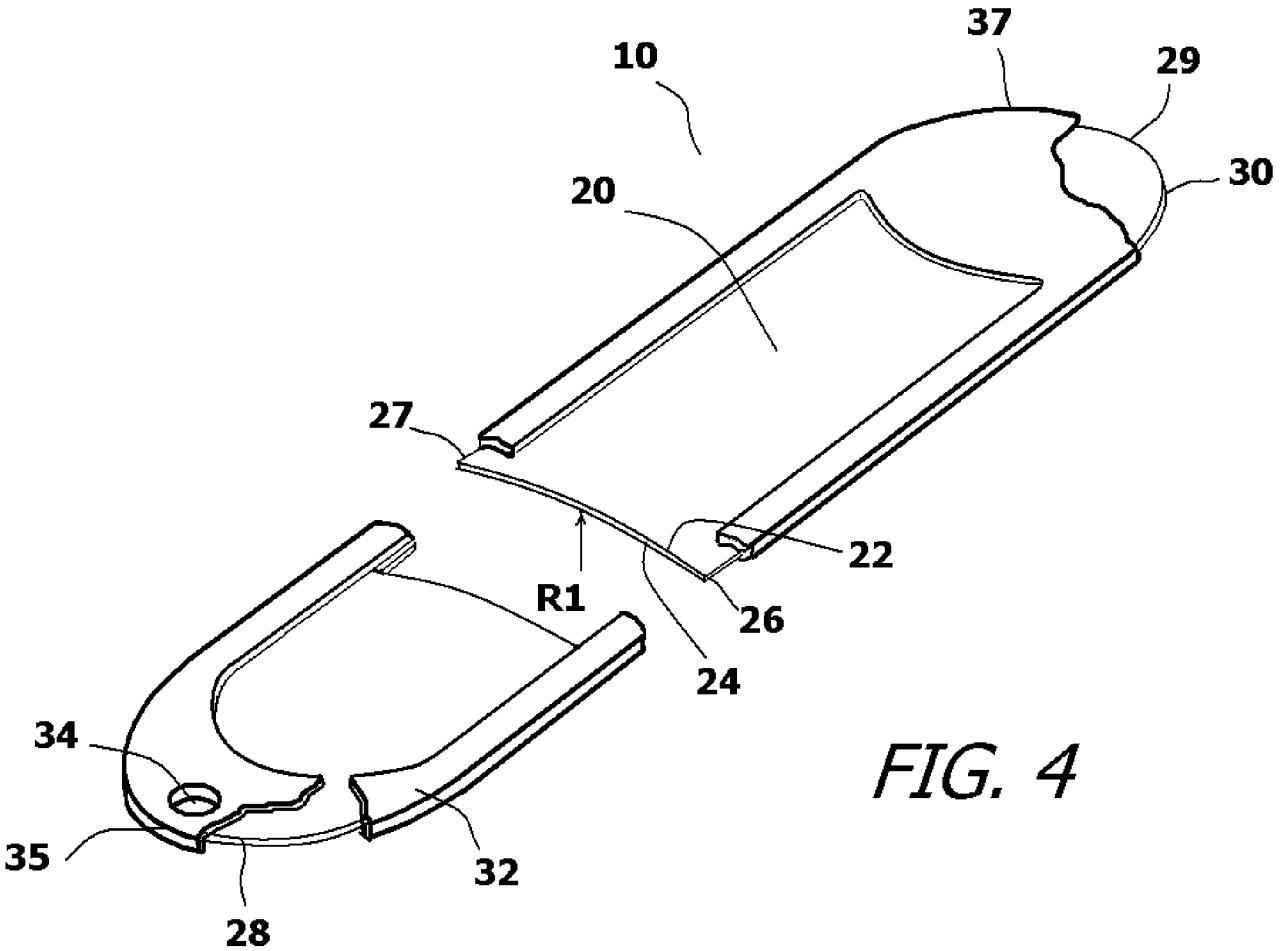
FIG. 4 is a selectively fragmented view of the projectile assembly.

Referring to FIG. 4 in conjunction with the earlier figures, it can be seen that the projectile assembly 10 is preferably made from a segment of ribbon spring 20. The ribbon spring 20 is preferably metal. However, a length of resilient plastic may also be used. The ribbon spring 20 has a top surface 22, a bottom surface 24, two long side edges 26, 27, and two short side edges 28, 29. The corners 30 where the long side edges 26, 27 meet the short side edges 28, 29 are preferably rounded so as not to present any salient points that can cause injury. The long side edges 26, 27 have a preferred length of between three inches and eight inches. The short side edges 28, 29 have a preferred length of between 0.5 inches and two inches.

Since the projectile assembly 10 will be used as a toy projectile, impact safety is important. The ribbon spring 20 is thin and can be metal. As such, the various edges of the ribbon spring 20 can present a cutting danger during a high speed impact. As such, the long side edges 26, 27 and the short side edges 28, 29 are preferably encased in a banding material 32. The banding material 32 is preferably an elastomeric material, such as a synthetic rubber or a foam rubber. However, soft formulations of plastic can be used. The banding material 32 can be dipped, painted or molded onto the ribbon spring 20. The banding material 32 covers the various edges 26, 27, 28, 29 of the ribbon spring 20 and can also be used to cover all or part of the top surface 22 and/or the bottom surface 24 as well. The primary purpose of the banding material 32 is to blunt the long side edges 26, 27 and the short side edges 28, 29. However, the banding material 32 is preferably thinly applied so as not to significantly affect the ability of the ribbon spring 20 to coil and uncoil. The result is a bi-stable projectile assembly 10 having a first end 35, a second end 37, and a periphery that is covered in banding material 32.

It will be understood that the use of a banding material 32 is preferred for safety, but not required. If not used, the long side edges 26, 27 and the short side edges 28, 29 of the ribbon spring 20 can be simply rounded for safety.

The ribbon spring 20 is formed and hardened as a coil. As such, the ribbon spring 20 has a bias that causes the ribbon spring 20 to automatically roll into the coiled configuration 12 of FIG. 1. When the ribbon spring 20 is in its coiled configuration 12, both the long side edges 26, 27 follow parallel spiral paths. The ribbon spring 20 is also formed with a radius of curvature R1 between the two long side edges 26, 27. When the ribbon spring 20 is straightened into the linear configuration 14 shown in FIG. 3, the top surface 22 of the ribbon spring 20 is convex and the bottom surface 24 of the ribbon spring 20 is concave. This radius of curvature R1 provides a structural stiffness to the ribbon spring 20 as long as the two long side edges 26, 27 are both parallel and straight. The structural stiffness provided to the ribbon spring 20 is sufficient to overcome the natural spring bias that acts to roll the ribbon spring 20 into its coiled configuration 12. Thus, the ribbon spring 20 is stable in both its coiled configuration 12 and its linear configuration 14.

When the ribbon spring 20 is in its linear configuration 14, the structural stiffness of the ribbon spring 20 acts against the natural spring bias of the ribbon spring 20. The ribbon spring 20 therefore stores spring energy as it is uncoiled from its coiled configuration 12 and into its linear configuration 14. As such, the moment the ribbon spring 20 is touched and the linear configuration 14 even slightly deformed, the stored spring energy is released and the ribbon spring 20 will rapidly recoil back into its coiled configuration 12.

Figure 6:
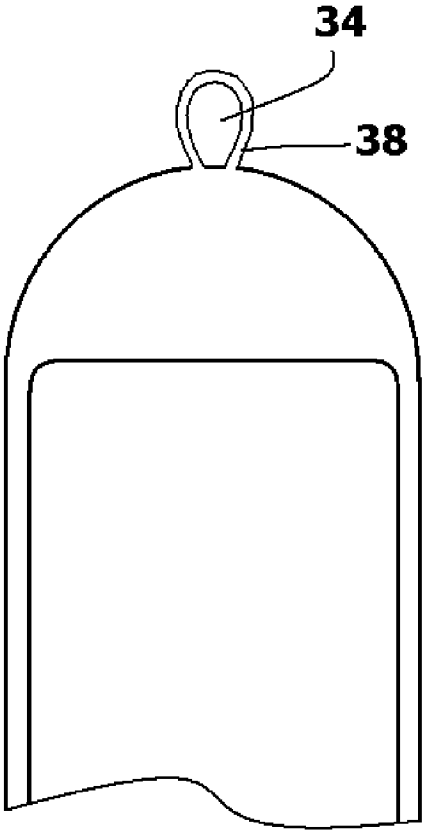
FIG. 6 is a fragmented view of a section of a projectile assembly showing an alternate catch hole position.
Figure 5:
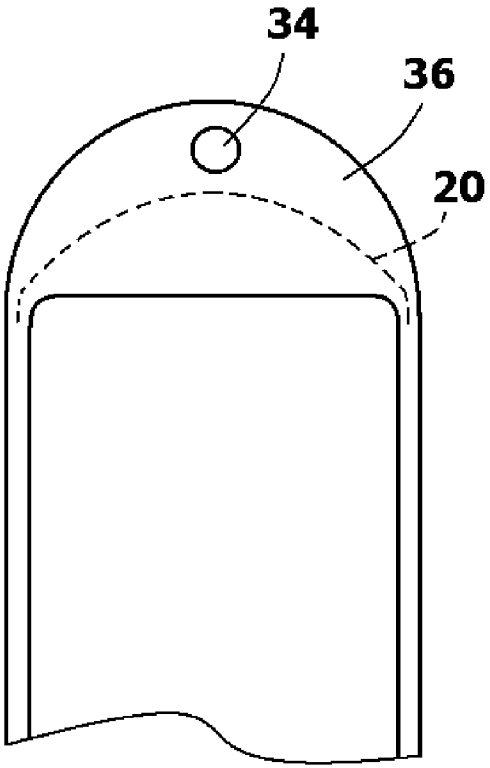
FIG. 5 is a fragmented view of a section of a projectile assembly showing an alternate catch hole position.

A catch hole 34 is provided on the projectile assembly 10 near one or both of the short side edges 28, 29 of the ribbon spring 20. The catch hole 34 can be formed through the ribbon spring 20 itself, as is shown in FIGS. 1 through 4. However, in alternate embodiments, the catch hole 34 can be formed through a flap 36 of the banding material 32, as is shown in FIG. 5. Alternatively, the catch hole 34 can be formed within a loop 38 of the banding material 32, as is shown in FIG. 6.

Figure 7:
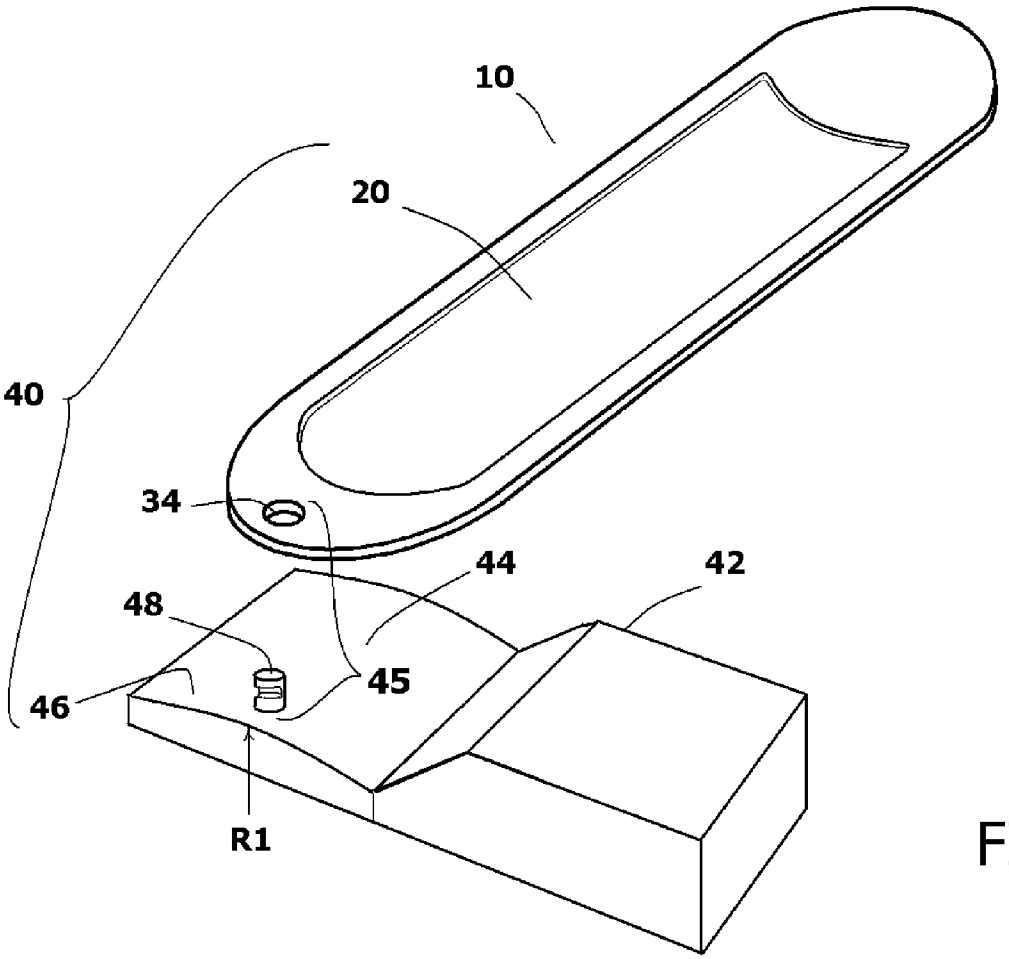
FIG. 7 is a perspective view of the exemplary embodiment of a toy system containing a projectile assembly and a launcher.

Referring now to FIG. 7, a full toy system 40 is shown that contains both the projectile assembly 10 and a launcher 42. The launcher 42 contains a launching platform 44. The launching platform 44 presents a curved surface 46. The curved surface 46 has the same radius of curvature R1 as does the ribbon spring 20 when the projectile assembly 10 is in its linear configuration 14. However, the launching platform 44 has a length that is preferably no longer than a third of the length of the projectile assembly 10.

A hook projection 48 extends upwardly from the apex of the curved surface 46 on the launching platform 44. The hook projection 48 is shaped and sized to pass through the catch hole 34 of the projectile assembly 10 when the projectile assembly 10 is placed on the launching platform 44. As such, the engagement of the hook projection 48 with the catch hole 34 creates a mechanical locking mechanism 45 that temporarily locks the first end 35 of the bi-stable projectile assembly 10 to the launching platform 44.

Figure 8:
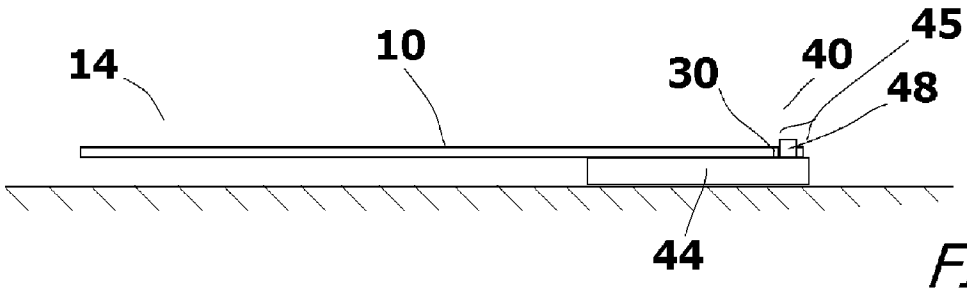
FIG. 8 is a side view of the system of FIG. 7 with the projectile assembly in a linear configuration.
Figure 9:
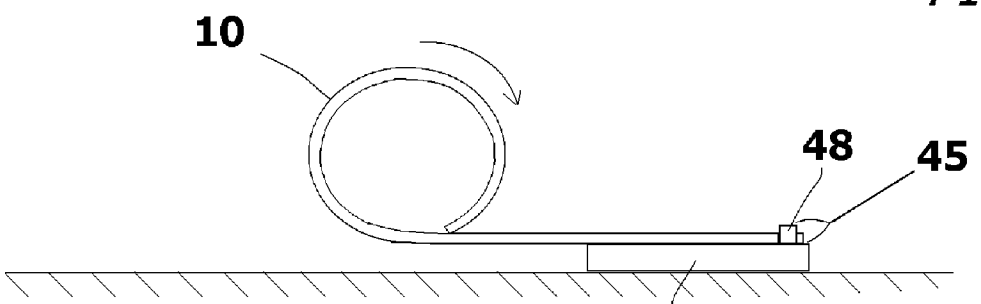
FIG. 9 is a side view of the system of FIG. 7 with the projectile assembly shown recoiling.
Figure 10:
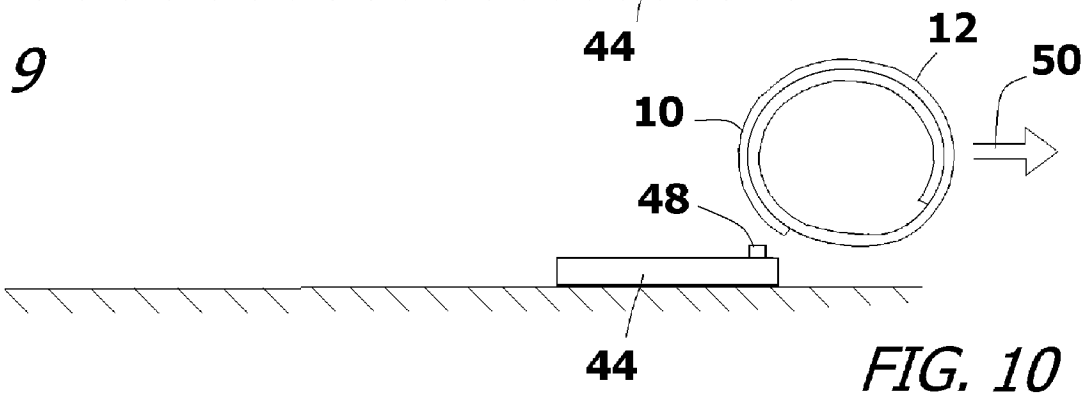
FIG. 10 is a side view of the system of FIG. 7 with the projectile assembly shown launching.

Referring to FIGS. 8, 9 and 10 in conjunction with FIG. 7, it will be understood that in order to utilize the toy system 40, the mechanical locking mechanism 45 is set by engaging the catch hole 34 on the projectile assembly 10 with the hook projection 48 on the launching platform 44. The catch hole 34 can have a cross-sectional profile with any geometric shape. The hook projection 48 has a cross-sectional profile that corresponds to the shape of the catch hole 34. As such, the projectile assembly 10 and the launching platform 44 can be keyed in shape so that only specific projectile assemblies can be used on specific launching platforms.

Once the catch hole 34 on the projectile assembly 10 is engaged with the hook projection 48 of the launching platform 44, the projectile assembly 10 is uncoiled towards its linear configuration 14. This stores spring energy in the ribbon spring 20. The projectile assembly 10 can be brought close to its linear configuration 14 and released before it stabilizes. Alternatively, the projectile assembly 10 can be brought fully into its stable linear configuration 14. If brought to the linear configuration 14, the projectile assembly 10 will lay straight, being partially supported by the launching platform 44. However, since the launching platform 44 is not as long as the projectile assembly 10, a section of the projectile assembly 10 will remain unsupported. If a downward force is applied to the projectile assembly 10 in the unsupported area, then the projectile assembly 10 will easily deform when contacted. The moment the projectile assembly 10 deforms, the stability of the linear configuration 14 fails. This causes the projectile assembly 10 to suddenly convert into its coiled configuration 12. However, since the catch hole 34 is engaged with the hook projection 48, the projectile assembly 10 can only coil toward the hook projection 48. This accelerates the projectile assembly 10 in the direction of arrow 50.

Referring to FIG. 10, it can be seen that as the projectile assembly 10 reaches its coiled configuration 12, the projectile assembly 10 has significant forward velocity and momentum. This enables the projectile assembly 10 to roll forward and disengage the hook projection 48. The projectile assembly 10 then rolls forward with significant speed. The forward velocity is large enough to launch the projectile assembly 10 directly into flight. However, if launched along the ground, the coiled configuration 12 of the projectile assembly 10 enables the projectile assembly 10 to roll along the ground like a wheel.

The launcher 42 and the launching platform 44 illustrated are fragments of a larger assembly. It will be understood that a toy manufacturer can mount the launching platforms on a variety of toys, such as the hands and mouth of toy monsters, on the roofs of toy army trucks, and any other place from which toy projectiles and/or toy vehicles are launched. A simple launcher 42 is illustrated merely to simplify the description.

Figure 11:
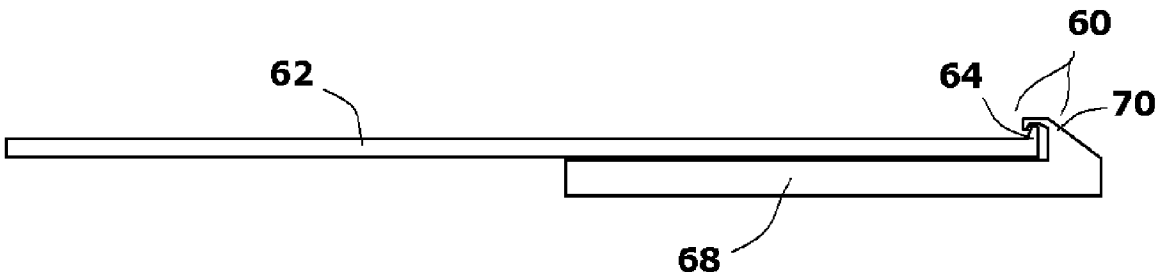
FIG. 11 is a side view of an alternate embodiment with the projectile assembly in a linear configuration.
Figure 12:
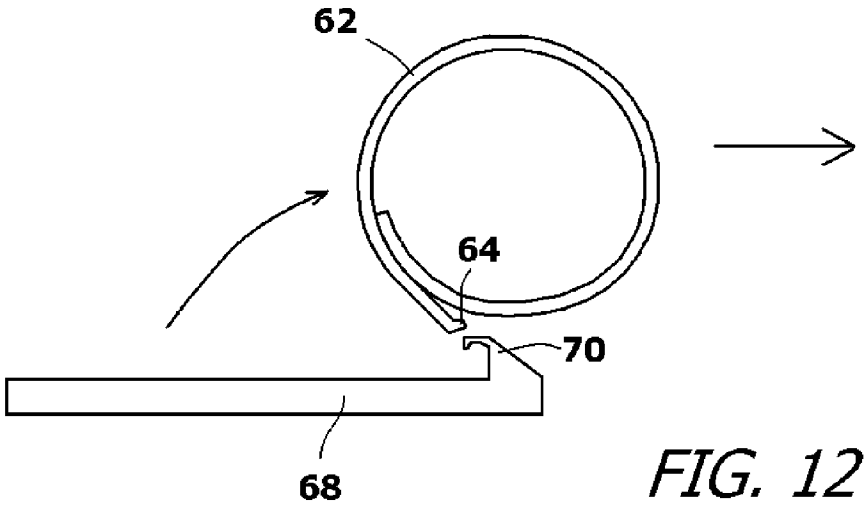
FIG. 12 is a side view of the system of FIG. 11 with the projectile assembly shown launching.

In the previous embodiments, the mechanical locking mechanism 45 that interconnects the projectile assembly 10 to the launcher 42 is created by the hook projection 48 on the launcher 42 engaging the catch hole 34 on the projectile assembly 10. However, it should be understood that other types of mechanical locking mechanisms can be used. Referring to FIG. 11 and FIG. 12, such an alternate mechanical locking mechanism 60 is shown. In this embodiment, a projectile assembly 62 is provided that does not have catch hole. Rather, a small blunt projection 64 extends upwardly near the front end 66 of the projectile assembly 62. A catch receptacle 70 is formed on the launcher 68. The catch receptacle 70 temporarily engages the blunt projection 64 and hold down the front end of the projectile assembly 62 during launching.

Figure 13:
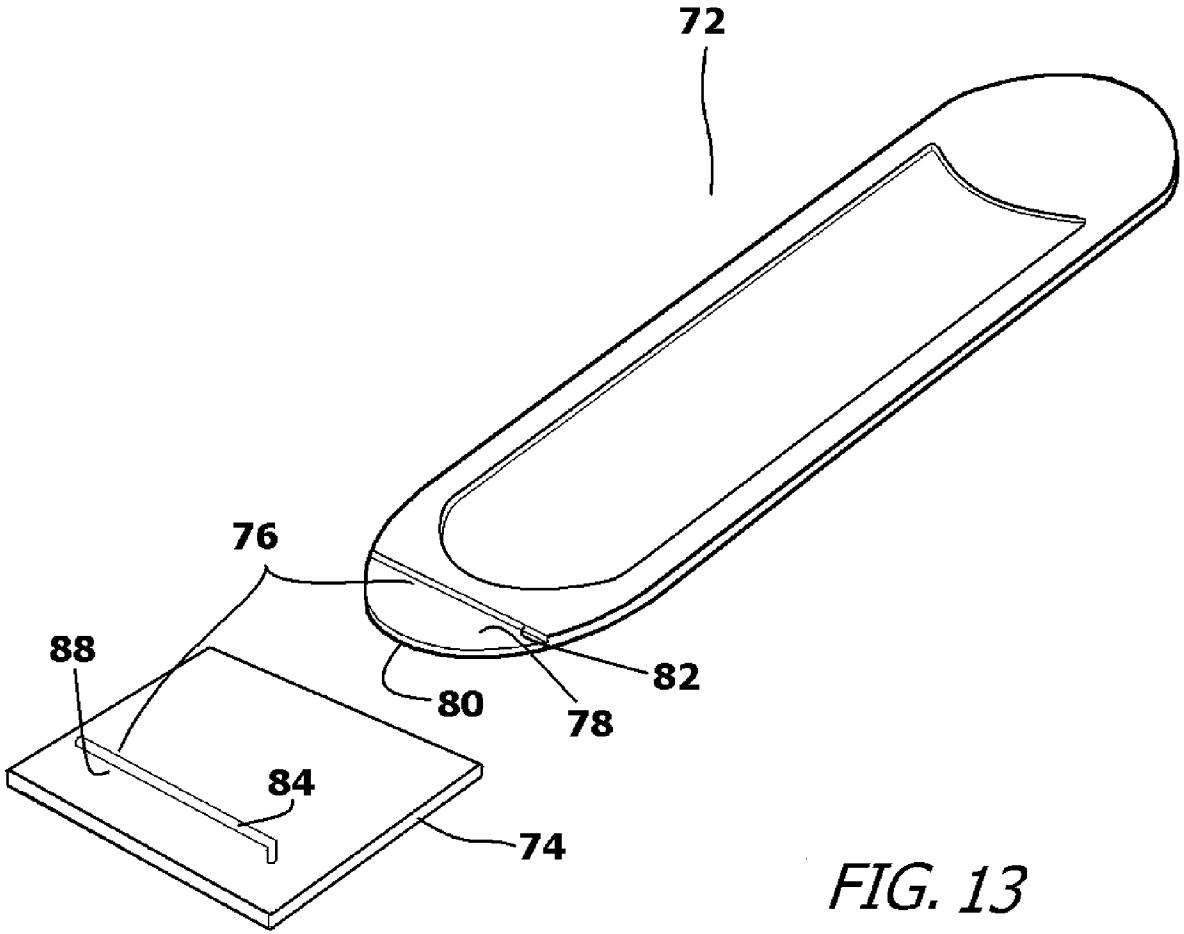
FIG. 13 is a perspective view of another alternate embodiment of a projectile assembly.

Referring to FIG. 13, another embodiment is shown for a projectile assembly 72 and launcher 74 that have an alternate mechanical locking mechanism 76. In this embodiment, a projectile assembly 72 is provided that does not have catch hole. Rather, a depressed area 78 is formed near the near the front end 80 of the projectile assembly 72. The presence of the depressed area 78 creates a ledge 82.

A catch bar 84 is formed on the launcher 74. A slot 88 is disposed under the catch bar 84. The slot 88 is sized to receive the depressed area 78 of the projectile assembly 72. However, the slot 88 is narrower than the ledge 82. As such, only the depressed area 78 of the projectile assembly 72 can pass under catch bar 84.

To utilize the system, the depressed area 78 of the projectile assembly 72 is placed under the catch bar 84. The projectile assembly 72 is then manually straightened into its linear configuration. When the projectile assembly 72 is released, it recoils into its coiled configuration. The depressed area 78 automatically retracts out of the slot 88 and the projectile assembly 72 is launched forward away from the launcher 74.

It will be understood that the embodiments of the present invention that are illustrated and described are merely exemplary and that a person skilled in the art can make many variations to those embodiments. All such embodiments are intended to be included within the scope of the present invention as defined by the claims.

What is claimed is:

1. A toy assembly, comprising:

a ribbon spring having a first end and a second end, wherein said ribbon spring is biased into a coiled configuration, and wherein said ribbon spring can be selectively uncoiled into a straight configuration; and a launching platform having a locking mechanism formed thereon that engages said ribbon spring proximate said first send, wherein said locking mechanism retains said ribbon spring as said ribbon spring is uncoiled toward said straight configuration from said coiled configuration, and wherein said locking mechanism releases said ribbon spring when said ribbon spring coils from said straight configuration toward said coiled configuration.

2. The assembly according to claim 1, wherein a hole is formed through said ribbon spring proximate said first end, and wherein said locking mechanism is a hook that engages said hole.

3. The assembly according to claim 1, wherein a projection is formed on said ribbon spring proximate said first end, and wherein said locking mechanism is a catch that engages said projection.

4. The assembly according to claim 1, wherein a depression is provided on said ribbon spring proximate said first end, and wherein said locking mechanism is a catch that engages said depression.

5. The assembly according to claim 1, wherein said ribbon spring has a top surface and a bottom surface defined between two long side edges and two short side edges.

6. The assembly according to claim 1, wherein said ribbon spring is bi-stable and can be configured into said coiled configuration and said straight configuration, wherein said ribbon spring is stable in both said coiled configuration and said straight configuration.

7. The assembly according to claim 6, wherein said long side edges of said ribbon spring follow spiral paths when in said coiled configuration and follow straight paths when in said straight configuration.

8. The assembly according to claim 7, wherein said ribbon spring as a radius of curvature between said long side edges that causes said bottom surface of said ribbon spring to be concave and said top surface of said ribbon spring to be convex when said ribbon spring is in said straight configuration.

9. The assembly according to claim 8, wherein said launching platform has a support surface that is convex and has a radius of curvature equal to said radius of curvature of said ribbon spring when said ribbon spring is in said linear configuration.

10. A toy assembly, comprising:

a launching platform;

a projectile that is biased into a coiled configuration between a first end and a second end, wherein said projectile stores spring energy when unwound from said coiled configuration into a linear configuration;

a temporary locking mechanism that connects said first end of said projectile to said launcher when said projectile is being unwound from said coiled configuration toward said linear configuration.

11. The assembly according to claim 10, wherein said projectile contains a ribbon spring.

12. The assembly according to claim 11, wherein said ribbon spring is bi-stable and can be configured in a stable manner into both said coiled configuration and said linear configuration.

13. The assembly according to claim 11, wherein said ribbon spring has a top surface and a bottom surface defined between two long side edges and two short side edges, wherein said long side edges of said ribbon spring follow spiral paths when in said coiled configuration and follow straight paths when in said linear configuration.

14. The assembly according to claim 13, wherein said ribbon spring has a radius of curvature between said long side edges that causes said bottom surface of said ribbon spring to be concave and said top surface of said ribbon spring to be convex when said ribbon spring is in said linear configuration.

15. The assembly according to claim 14, wherein said launching platform has a support surface that is convex and has a radius of curvature equal to said radius of curvature of said ribbon spring when said ribbon spring is in said linear configuration.

* * * * *